US011201026B2

(12) United States Patent
Su et al.

(10) Patent No.: US 11,201,026 B2
(45) Date of Patent: Dec. 14, 2021

(54) PROTECTION DEVICE AND CIRCUIT PROTECTION APPARATUS CONTAINING THE SAME

(71) Applicant: Polytronics Technology Corp., Hsinchu (TW)

(72) Inventors: Tsung Min Su, Hsinchu (TW); Chia-Mao Chen, Ji'an Township, Hualien County (TW); David Shau-Chew Wang, Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 16/844,504

(22) Filed: Apr. 9, 2020

(65) Prior Publication Data

US 2021/0183605 A1 Jun. 17, 2021

(30) Foreign Application Priority Data

Dec. 13, 2019 (TW) ..... 108145804

(51) Int. Cl.

| | |
|---|---|
| ***H01H 85/046*** | (2006.01) |
| ***H01H 85/08*** | (2006.01) |
| ***H01H 85/06*** | (2006.01) |
| ***H01H 85/00*** | (2006.01) |

(Continued)

(52) U.S. Cl.

CPC ..... *H01H 85/046* (2013.01); *H01H 85/0065* (2013.01); *H01H 85/06* (2013.01); *H01H 85/08* (2013.01); *H01H 85/463* (2013.01); *H01H 2085/0555* (2013.01)

(58) Field of Classification Search

CPC .. H05K 85/0065; H05K 85/046; H05K 85/06; H05K 85/08; H05K 85/463; H05K 2085/0065; H05K 2085/0555

See application file for complete search history.

(56) References Cited

U.S. PATENT DOCUMENTS

| | | | | |
|---|---|---|---|---|
| 10,181,715 | B2 * | 1/2019 | Su | H02H 5/041 |
| 2005/0141164 | A1 * | 6/2005 | Bender | H01H 85/0047 361/104 |

(Continued)

FOREIGN PATENT DOCUMENTS

| | | | |
|---|---|---|---|
| JP | 2004185960 | A * | 7/2004 |
| WO | WO-2013146889 | A1 | 10/2013 |

OTHER PUBLICATIONS

Yoshida. EPO Translation of JP 2004185960 A. (Year: 2004).*

*Primary Examiner* — Jacob R Crum

(74) *Attorney, Agent, or Firm* — Muncy, Geissler, Olds & Lowe, P.C.

(57) ABSTRACT

A protection device comprises a substrate, a fusible element and a heating element. The substrate comprises a first electrode and a second electrode on its surface. The fusible element is disposed on the substrate and connects to the first electrode and the second electrode at two ends. The fusible element comprises a first metal layer and a second metal layer disposed on the first metal layer. The second metal layer has a lower melting point than that of the first metal layer. The heating element is disposed on the substrate. In the event of over-voltage or over-temperature, the heating element heats up to melt and blow the fusible element. The second metal layer is 40-95% of the fusible element in thickness.

12 Claims, 3 Drawing Sheets

(51) Int. Cl.
*H01H 85/46* (2006.01)
*H01H 85/055* (2006.01)

(56) References Cited

U.S. PATENT DOCUMENTS

2007/0060980 A1* 3/2007 Strother ..... A61N 1/0551
607/61
2015/0037624 A1* 2/2015 Thompson ..... H01M 10/425
429/50
2015/0084734 A1* 3/2015 Yoneda ..... H01H 85/06
337/183
2016/0071680 A1* 3/2016 Mukai ..... H01H 37/761
337/183
2017/0236665 A1* 8/2017 Furuuchi ..... H01H 37/761
337/414
2017/0236667 A1* 8/2017 Furuuchi ..... H01H 37/761
327/525
2017/0236673 A1* 8/2017 Yoneda ..... H01H 85/10
337/293
2017/0288428 A1* 10/2017 Ishikawa ..... H02J 7/0026

* cited by examiner

PROTECTION DEVICE AND CIRCUIT PROTECTION APPARATUS CONTAINING THE SAME

BACKGROUND OF THE INVENTION

(1) Field of the Invention

The present application relates to a protection device applied to an electronic apparatus and a circuit protection apparatus containing the same. More specifically, it relates to a protection device and a circuit protection apparatus capable of preventing over-voltage, over-current and/or over-temperature.

(2) Description of the Related Art

Fuses containing low-melting metals, e.g., lead, tin, silver, bismuth, and copper, are well-known protection devices to cut off currents. To prevent over-current and over-voltage, various protection devices are continuously developed. For example, a device containing a substrate on which a heating layer and a low-melting metal layer are stacked in sequence. The heating layer heats up in the event of over-voltage, and then the heat is transferred upwards to the low-melting metal layer. As a result, the low-melting metal layer is melted and blown to sever currents flowing therethrough, so as to protect circuits or electronic apparatuses.

Recently, mobile apparatuses such as cellular phones and laptop computers are widely used, and people increasingly rely on such products over time. However, burnout or explosion of batteries of cellular phones or portable products during charging or discharging is often seen. Therefore, the manufacturers continuously improve the designs of over-current and over-voltage protection devices to prevent the batteries from being blown due to over-current or over-voltage during charging or discharging.

In a know protection device, the low-melting metal layer is in series connection to a power line of a battery, and the low-melting metal layer and a heating layer are electrically coupled to a switch and an integrated circuit (IC) device. When the IC device detects an over-voltage event, the IC device enables the switch to "on". As a result, current flows through the heating layer to generate heat to melt and blow the low-melting metal layer, so as to sever the power line to the battery for over-voltage protection. Moreover, it can be easily understood that the low-melting metal layer, e.g., fuses, can be heated and blown by a large amount of current in the event of over-current, and therefore over-current protection can be achieved also.

The low-melting metal layer of the protection device usually uses lead-containing solder of a melting point larger than 300° C. so as not to be blown during a high-temperature reflow process. However, the lead-containing solder is restricted in Restriction of Hazardous Substances (RoHS) Directive. It is a challenge to proceed with reflow for a fusible element having a lower melting point.

SUMMARY OF THE INVENTION

The present application provides a protection device and a circuit protection apparatus containing the same for over-current, over-voltage and/or over-temperature protection. The fusible element of the protection device comprises two metal layers of different melting points by which the composite material of high and low melting points induces effective blowout of the fusible element.

In accordance with a first aspect of the present application, a protection device comprises a substrate, a fusible element and a heating element. The substrate comprises a first electrode and a second electrode on its surface. The fusible element is disposed on the substrate and connects to the first electrode and the second electrode at two ends. The fusible element comprises a first metal layer and a second metal layer disposed on the first metal layer. The second metal layer has a lower melting point than that of the first metal layer. The heating element is disposed on the substrate. In the event of over-voltage or over-temperature, the heating element heats up to melt and blow the fusible element. The second metal layer is 40-95% of the fusible element in thickness.

In an embodiment, the second metal layer is thicker than the first metal layer.

In an embodiment, the first metal layer comprises silver (Ag), copper (Cu), gold (Au), nickel (Ni), zinc (Zn) and alloy thereof.

In an embodiment, the second metal layer comprises tin (Sn) and alloy thereof.

In an embodiment, the first metal layer is an inner layer of the fusible element and the second metal layer is an outer layer of the fusible element.

In an embodiment, the second metal layer comprises two layers disposed on an upper surface and a lower surface of the first metal layer.

In an embodiment, the first metal layer forms a bottom surface of the fusible element and the second metal layer forms a top surface of the fusible element.

In an embodiment, if the first metal layer has a thickness equal to or greater than 16 μm, the second metal layer has a thickness greater than 50% of a thickness of the fusible element.

In an embodiment, if the first metal layer has a thickness equal to or greater than 18 μm, the second metal layer has a thickness greater than 60% of a thickness of the fusible element.

In accordance with a second aspect of the present application, a circuit protection apparatus comprises a protection device, a detector and a switch. The protection device comprises a substrate, a fusible element and a heating element. The substrate comprises a first electrode and a second electrode on its surface. The fusible element is disposed on the substrate and connects to the first electrode and the second electrode at two ends. The fusible element comprises a first metal layer and a second metal layer disposed on the first metal layer. The second metal layer has a lower melting point than that of the first metal layer. The second metal layer is 40-95% of the fusible element in thickness. The heating element is disposed on the substrate. The detector is adapted to detect voltage drops or temperatures of a circuit to be protected, and the switch is coupled to the detector to receive its sensing signals. When the detector senses the voltage drop or the temperature exceeding a threshold value, the switch turns on to allow current to flow through the heating element by which the heating element heats up to blow the fusible element.

The fusible element of the protection device is a composite structure in which the first metal layer has a higher melting point than that of the second metal layer and the second metal layer comprises a certain thickness in the fusible element. As a result, even if the reflow temperature is higher than the melting point of the second metal layer, the second metal layer would not flow randomly to be deformed during reflow due to its certain thickness. Moreover, a molten second metal layer erodes the first metal layer to speed up blowout of the fusible element. Compared to traditional tin sheet containing lead, the fusible element of the protection device of the present application comprising metal layers of different melting points has a lower resistance to obtain a lower surface temperature and a high current.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
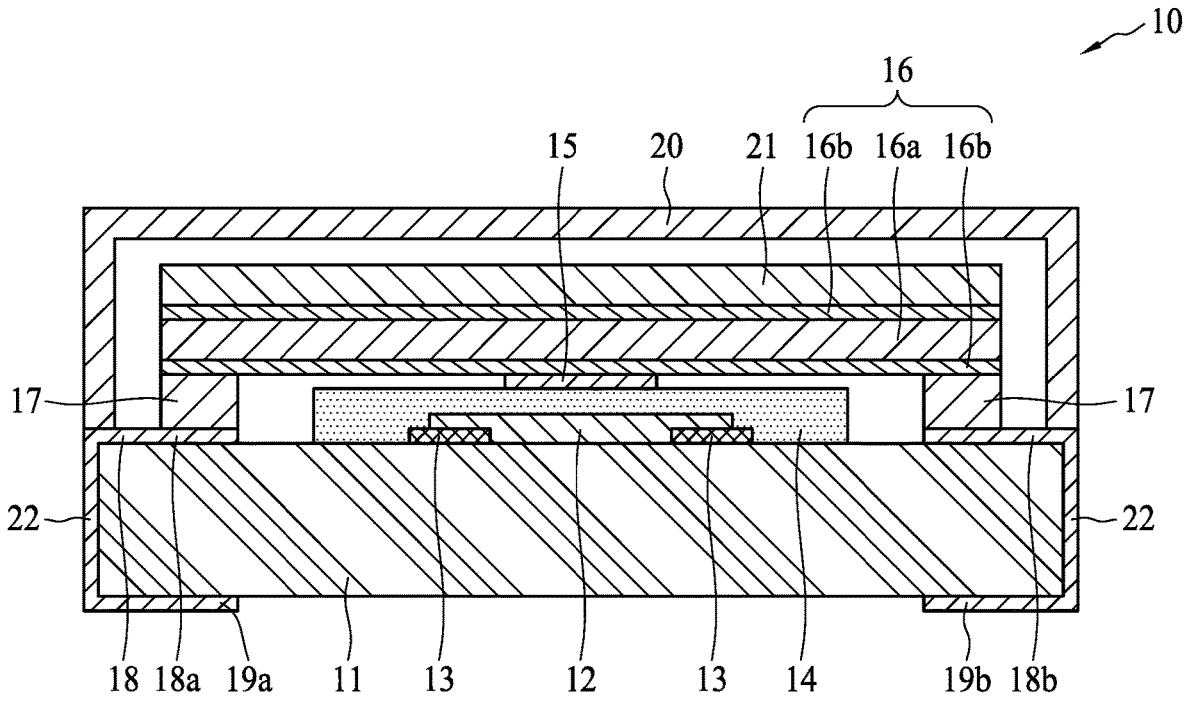
FIG. 1 shows a protection device in accordance with an embodiment of the present application.
Figure 2:
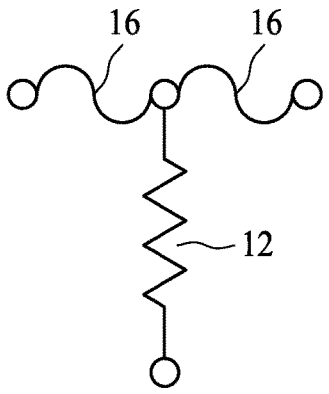
FIG. 2 shows an equivalent circuit diagram of the protection device of FIG. 1.

FIG. 1 shows a protection device 10 in accordance with an embodiment of the present application. The protection device 10 comprises a substrate 11, a heating element 12, heating element electrodes 13, an insulating layer 14, an intermediate electrode 15, a fusible element 16, solders 17, an electrode layer 18, lower electrodes 19*a* and 19*b* and a housing 20. The rim of the housing 20 is placed on the substrate 11 to form a space to receive the heating element 12 and the fusible element 16. The substrate 11 is usually a planar insulating substrate. The heating element 12 is disposed on the substrate 11 and connects to the heat element electrodes 13 at two ends. The fusible element 16 electrically connects to a first electrode 18*a* and a second electrode 18*b* of the electrode layer 18, and a center of the fusible element 16 connects to the intermediate electrode 15 disposed on the insulating layer 14. The fusible element 16 connects to the first electrode 18*a* and the second electrode 18*b* at two ends through solders 17. The first electrode 18*a* and the second electrode 18*b* connects to the lower left electrode 19*a* and lower right electrode 19*b* respectively through conductive members 22 on the sidewalls of the substrate 11. The lower electrodes 19*a* and 19*b* serve as interfaces for surface-mounting onto a circuit board. The insulating layer 14 covers the heating element 12 and the heating element electrodes 13. The fusible element 16 is disposed above the insulating layer 14 and serve as fuses in a circuit. The fusible element 16 is a composite structure comprising a first metal layer 16*a* and a second metal layer 16*b* disposed on the first metal layer 16*a*. A flux 21 may be fully or partially daubed on the fusible element 16 to prevent oxidation of the first metal layer 16*a* and the second metal layer 16*b*. The flux 21 can form an anti-oxidation layer on the second metal layer 16*b* to avoid oxidation so as to sustain blowing efficiency. When over-voltage or over-temperature occurs, the heating element 12 heats up and generated heat is transferred to the fusible element 16. The fusible element 16 is melted and flows to the first electrode 18*a*, the second electrode 18*b* and the intermediate electrode 15, and as a result the fusible element 16 is blown to sever the current for protection to the circuit. FIG. 2 is an equivalent circuit diagram of the protection device 10 of FIG. 1, by virtue of the intermediate electrode 15, the fusible element 16 is devised to comprise two fuses which will be blown by the heat from the heating element 12 as mentioned above in the event of over-voltage or over-temperature.

In an embodiment, the substrate 11 may be a rectangular insulating substrate including aluminum oxide, aluminum nitride, zirconium oxide, glass, or ceramic, or may use the material for printed circuit layout such as glass epoxy substrate or phenolic substrate. The substrate 11 has a thickness of about 0.1-2 mm. The electrode layer 18, the heating element electrodes 13 and the intermediate electrode 15 may comprise silver, gold, copper, tin, nickel or other conductive metals, and its thickness is approximately 0.005-1 mm, or 0.01 mm, 0.05 mm, 0.1 mm, 0.3 mm or 0.5 mm in particular. In addition to making the electrodes by printing, they may be alternatively made of metal sheets for high-voltage applications.

The fusible element 16 is a composite structure comprising inner and outer layers and may be in the shape of a rectangular bar or a round bar. The first metal layer 16*a* is the inner layer of a higher melting point, and the second metal layer 16*b* is the outer layer of a lower melting point. In other words, the second metal layer 16*b* has a lower melting point than that of the first metal layer 16*a*. The second metal layer 16*b* can be formed on the first metal layer 16*a* by electroplating, vapor deposition, sputtering, attachment or extrusion. The first metal layer 16*a* may comprise silver, copper, gold, nickel, zinc, or alloys thereof. The second metal layer 16*b* may comprise tin or its alloy such as Sn, Sn—Ag, Sn—Sb, Sn—Zn, Sn—Ag—Cu, Pb—Sn—Ag, Sn—Zn—Cu, Sn—Bi—Ag and Sn—Bi—Ag—Cu. In the present application, it is preferable to use but not limited to the lead-free materials to comply with RoHS Directive. In addition to a lower melting point of the second metal layer 16*b* compared to the first metal layer 16*a*, the melting point of the first metal layer 16*a* may be higher than a reflow temperature. As a result, even if a reflow temperature is higher than the melting point of the second metal layer 16*b*, a surface of the second metal layer 16*b* may slightly flow but the first metal layer 16*a* is not melted during reflow. Therefore, the fusible element 16 is not blown and sustains its original shape. The heating element 12 may comprise ruthenium oxide ($RuO_2$) with additives of silver (Ag), palladium (Pd), and/or platinum (Pt). The insulating layer 14 between the heating element 12 and the fusible element 16 may contain glass, epoxy, aluminum oxide, silicone or glaze.

In an embodiment, the fusible element 16 has a thickness T of about 15-150 μm. The first metal layer 16*a* has a thickness T1 of about 5-30 μm. Either upper or lower second metal layer 16*b* has a thickness of 5-50 μm, and therefore the second metal layer 16*b* has a total thickness T2 of 10-100 μm. T2 may be larger or less than T1, and the thickness of the second metal layer is preferably 40-95% of the thickness of the fusible element. That is, T=T1+T2, and T2/T=40-95%, e.g., 50%, 60%, 70%, 80% or 90%. In an embodiment, the second metal layer 16*b* is thicker than the first metal layer 16*a*, or the second metal layer 16*b* has a larger volume than the first metal layer 16*a*. In the event of an abnormality of over-voltage or over-current, the second metal layer 16*b* having larger thickness or volume can erode the first metal layer 16*a* effectively to speed up the blowout of the fusible element 16. In summary, there are adequate ratios in terms of volumes and thicknesses of the first metal layer 16*a* compared to the second metal layer 16*b*. In case of a thin or small volumetric second metal layer 16*b*, the fusible element 16 may not be blown timely and effectively.

Figure 3:
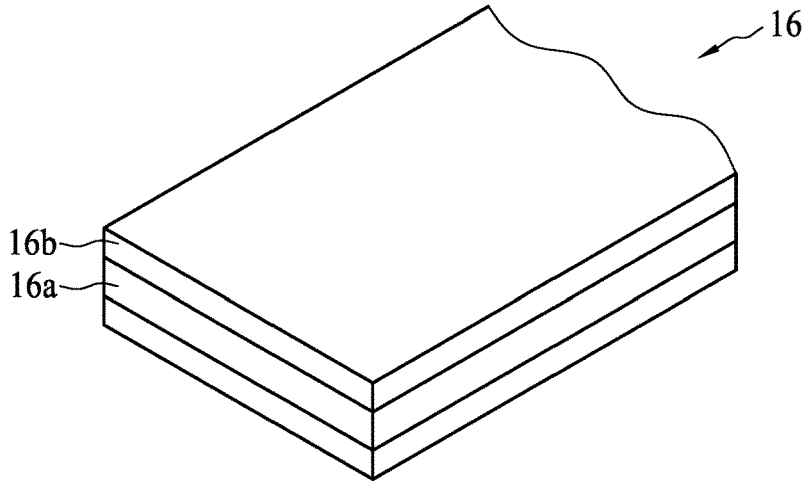
FIGS. 3-6 show fusible elements in accordance with some embodiments of the present application.
Figure 4:
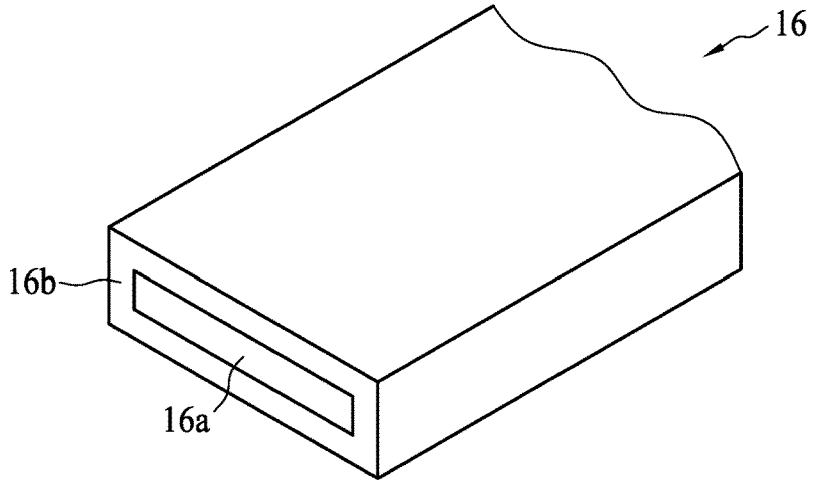
Figure 5:
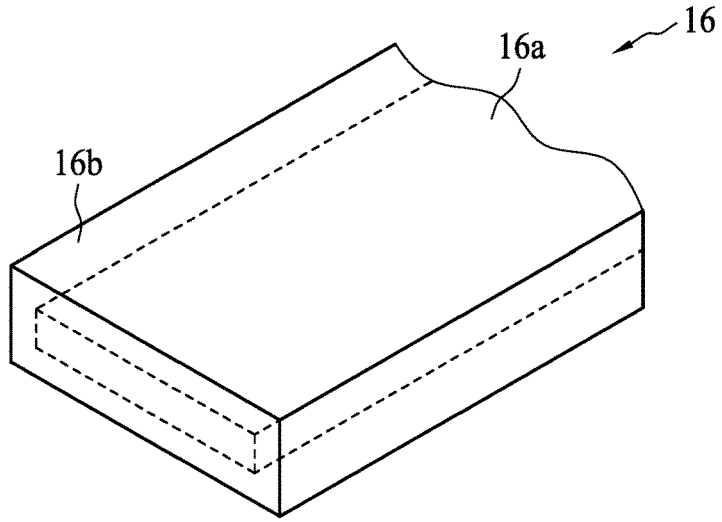
Figure 6:
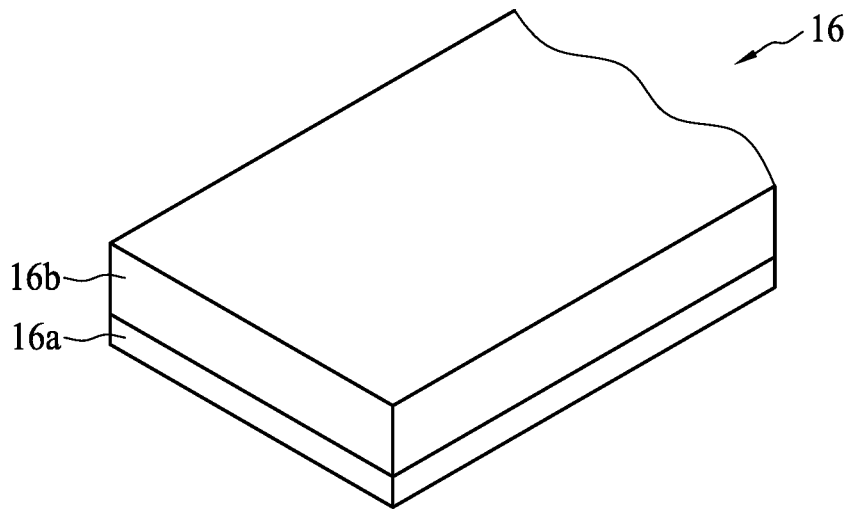

FIG. 3, FIG. 4, FIG. 5 and FIG. 6 show fusible elements 16 in accordance with different embodiments. In FIG. 3, the second metal layers 16*b* are disposed on upper and lower surfaces of the first metal layer 16*a*. In FIG. 4, the second metal layer 16*b* encloses the first metal layer 16*a* except two opposite ends. In FIG. 5, the second metal layer 16*b* fully encloses the first metal layer 16*a*. In FIGS. 3, 4 and 5, the first metal layer 16*a* is an inner layer of the fusible element 16 and the second metal layer 16*b* is an outer layer of the fusible element 16. The thickness T2 of the second metal layer 16*b* is a total thickness of upper and lower portions of the second metal layer 16*b*. In FIG. 6, the fusible element 16 comprises a first metal layer 16*a* and a second metal layer 16*b* disposed on the first metal layer 16*a*. The first metal layer 16*a* forms a lower surface of the fusible element 16 and the second metal layer 16*b* forms an upper surface of the fusible element 16. In an embodiment, the second metal layer 16*b* is thicker than the first metal layer 16*a*.

Table 1 exemplifies fusible elements with a structure shown in FIG. 3. Each of the fusible elements has a width of 1.85 mm and a length of 1.85 mm, and upper and lower portions of the second metal layer 16*b* are disposed on the upper and lower surfaces of the first metal layer 16*a*. The first metal layer 16*a* is a silver layer of a thickness of 5 μm, 7 μm, 9 μm, 12 μm, 14 μm, 16 μm, 18 μm or 20 μm. The second metal layer 16*b* comprises an upper tin layer and a lower tin layer. Each tin layer has a thickness of 5 μm, 10 μm, 20 μm, or 30 μm. Table 1 shows ratios of the thickness T2 of the second metal layer to the total thickness T of the fusible element, i.e., T2/T, in percentage. Because the second metal layer comprises two tin layers, T2 is twice the thickness of a single tin layer. In Table 1, T2/T1 is 32-95%. The upper right region in Table 1 is the cases of large T2/T, whereas the lower left region in Table 1 is the cases of small T2/T. The fusible elements in Table 1 are subjected to a reflow test at a temperature of 260° C. After reflow, all fusible elements remain original shapes without obvious tin-melting.

TABLE 1

| | Sn layer | | | |
|---|---|---|---|---|
| Ag layer | 5 μm | 10 μm | 20 μm | 30 μm |
| 5 μm | 66.67% | 80% | 88.89% | 92.31% |
| 7 μm | 58.82% | 74.07% | 85.11% | 89.55% |
| 9 μm | 52.63% | 68.97% | 81.63% | 86.96% |
| 12 μm | 45.45% | 62.5% | 76.92% | 83.33% |
| 14 μm | 41.67% | 58.82% | 74.07% | 81.08% |
| 16 μm | 38.46% | 55.56% | 71.43% | 78.95% |
| 18 μm | 35.71% | 52.63% | 68.97% | 76.92% |
| 20 μm | 33.33% | 50% | 66.67% | 75% |

The fusible elements in Table 1 are sequentially manufactured to be the protection devices of a structure illustrated in FIG. 1, and the protection devices are subjected to over-voltage tests. In over-voltage tests, different currents are applied to the heating element of the protection device to generate various powers such as 7 W, 10 W and 35 W so as to verify whether the fusible element is blown to "open circuit" or remains "closed circuit," and the test results are shown in Table 2. The tests showing "open circuit" are "PASS", and the tests showing "closed circuit" are "NG" It is observed from Table 1 and Table 2 that T2/T values of "PASS" tests are 40-95%. For a thicker first metal layer, T2/T is larger. If the first metal layer (silver layer) has a thickness equal to or greater than 16 μm, T2/T has to be greater than 50% to attain effective blowout of the fusible element (PASS). For a case in Table 1 that the thickness of the first metal layer is 16 μm and T2/T is 38.46%, the test result is "NG" If the first metal layer (silver layer) has a thickness equal to or greater than 18 μm, T2/T is greater than 60% to attain effective blowout of the fusible element (PASS). If the first metal layer (silver layer) has a thickness equal to or greater than 20 μm, T2/T is greater than 70% to attain effective blowout of the fusible element (PASS). In other words, a thicker first metal layer has a larger T2/T to effectively blow the fusible element to form "open circuit."

TABLE 2

| | Sn layer | | | |
|---|---|---|---|---|
| Ag layer | 5 μm | 10 μm | 20 μm | 30 μm |
| 5 μm | PASS | PASS | PASS | PASS |
| 7 μm | PASS | PASS | PASS | PASS |
| 9 μm | PASS | PASS | PASS | PASS |
| 12 μm | PASS | PASS | PASS | PASS |
| 14 μm | PASS | PASS | PASS | PASS |
| 16 μm | NG | PASS | PASS | PASS |
| 18 μm | NG | NG | PASS | PASS |
| 20 μm | NG | NG | NG | PASS |

Table 3 shows embodiments of the present application with fusible elements as shown in FIG. 3. Each of the fusible elements has a width of 1.85 mm and a length of 1.85 mm. Table 3 shows the data of the thickness of the first metal layer (silver layer), the thickness of the second metal layer (tin layer), the resistance of the fusible element and blowout times for different heating powers 7 W, 10 W and 35 W in an over-voltage test. With the same thickness of tin layer, a thicker silver layer incurs a longer blowout time. In contrast, the fusible element of a thicker tin layer (a larger T2/T) has a shorter blowout time and better blowing efficiency. In Table 3, all the fusible elements are blown within 10 seconds.

TABLE 3

| Ag layer thickness | Sn layer thickness | Fusible element (mΩ) | Over-voltage test heating power & blowout time (sec) | |
|---|---|---|---|---|
| 9 μm | 5 μm | 0.8-1.2 | 7 W | 3.71-3.76 |
| | | | 10 W | 1.52-1.77 |
| | | | 35 W | 0.24-0.27 |
| 12~13 μm | 5 μm | 0.8-0.9 | 7 W | 3.86-5.06 |
| | | | 10 W | 1.69-1.81 |
| | | | 35 W | 0.27-0.29 |
| 14~15 μm | 5 μm | 0.8-0.9 | 7 W | 5.58-7.43 |
| | | | 10 W | 2.23-2.26 |
| | | | 35 W | 0.38-0.41 |
| 9 μm | 10 μm | 0.9-1.1 | 7 W | 3.08-4.51 |
| | | | 10 W | 1.16-1.67 |
| | | | 35 W | 0.22-0.26 |
| 14~15 μm | 10 μm | 0.8 | 7 W | 4.17-9.17 |
| | | | 10 W | 1.54-1.84 |
| | | | 35 W | 0.31-0.32 |
| 9 μm | 20 μm | 0.8-0.9 | 7 W | 2.81-3.71 |
| | | | 10 W | 1.31-1.38 |
| | | | 35 W | 0.21-0.22 |
| 14~15 μm | 20 μm | 0.7 | 7 W | 4.36-4.77 |
| | | | 10 W | 1.98-3.07 |
| | | | 35 W | 0.26-0.29 |

TABLE 3-continued

| Ag layer thickness | Sn layer thickness | Fusible element (mΩ) | Over-voltage test heating power & blowout time (sec) | |
|---|---|---|---|---|
| 9 μm | 30 μm | 0.9 | 7 W | 2.68-2.76 |
| | | | 10 W | 1.31-1.32 |
| | | | 35 W | 0.21-0.24 |
| 14~15 μm | 30 μm | 0.7 | 7 W | 4.51-6.65 |
| | | | 10 W | 1.94-2.91 |
| | | | 35 W | 0.26-0.31 |

Figure 7:
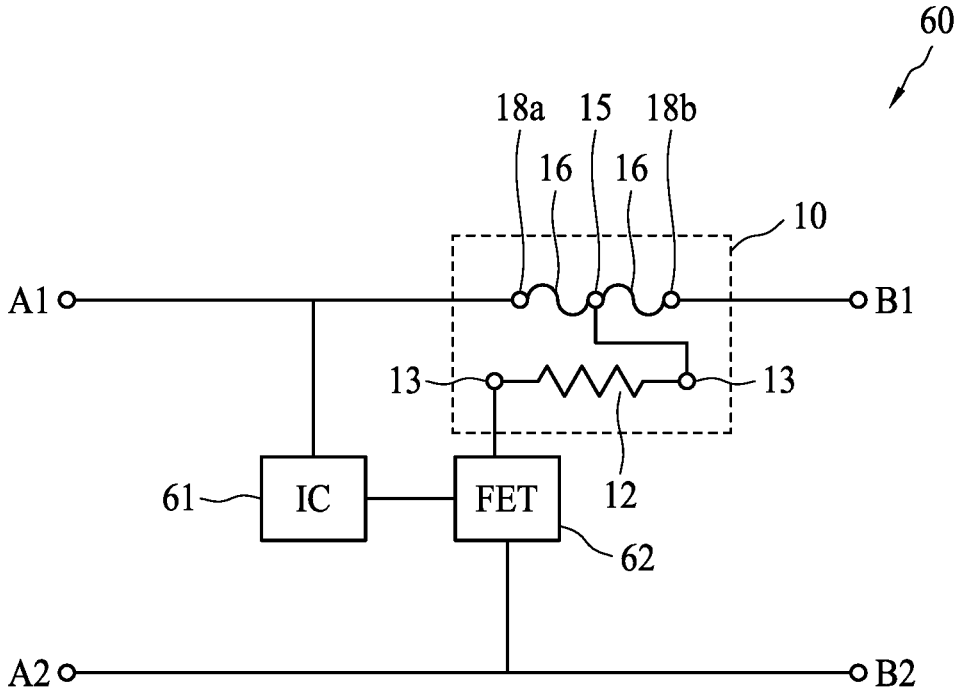
FIG. 7 shows a circuit diagram of a circuit protection apparatus in accordance with an embodiment of the present application.

The equivalent circuit diagram of the protection device 10 of this embodiment is depicted in a dashed-line block in FIG. 7. The first electrode 18*a* connects to a terminal A1 of an apparatus to be protected such as a secondary battery or a motor, whereas the second electrode 18*b* connects to a terminal B1 of a charger or the like. The intermediate electrode 15 connects to a heating element electrode 13 and another heating element electrode 13 connects to a switch 62. According to this circuit design of the protection device 10, the fusible element 16 forms a circuit containing two fuses in series connection, and the heating element 12 forms a heater denoted by a resistor. In an embodiment, the switch 62 may be a field-effect transistor (FET). The gate electrode of the switch 62 connects to a detector 61, and the switch 62 connects to a terminal A2 of the apparatus to be protected and a terminal B2 of the charger. The detector 61 may be an IC device capable of sensing voltage drops and temperatures of the circuit. If no over-voltage and over-temperature event, the switch 62 is off, current flows through fusible element 16 and no current flows through the heating element 12. If over-current occurs, the fusible element 16 is blown to provide over-current protection. When the detector 61 senses a voltage or a temperature larger than a threshold value, i.e., over-voltage or over-temperature, the switch 62 turns on to allow current to flow through the source and drain electrodes of the switch 62 and the heating element 12, and accordingly the heating element 12 heats up to blow the fusible element 16 to provide over-voltage and over-temperature protections. In summary, two power lines of B1 to A1 and B2 to A2 supply power to the circuit to be protected. The protection device 10, the detector 61 and the switch 62 are coupled to the two power lines to form a circuit protection apparatus 60. If the detector 61 senses a voltage drop or a temperature over a threshold value, then the heating element 12 is activated to blow the fusible element 16.

The equivalent circuit diagrams of the protection devices of the aforesaid embodiments comprise two fuses and a heater. Nevertheless, variant designs in terms of structure or circuit may be used to form a protection device containing two fuses and two heaters, or one fuse and one heater, which are also covered by the scope of the present application. In an embodiment, the fusible element may electrically connect to two bonding pads to form a current path and the heating element electrically connect to another two bonding pads to form another current path, so as to independently control the current flowing through the heating element to blow the fusible element.

The protection device of the present application comprises a composite fusible element having a first metal layer of a high melting point and a second metal layer of a low melting point, and the fusible element comprises a certain amount of the second metal layer in thickness. When the fusible element is molten, the second metal layer erodes the first metal layer to blow the fusible element quickly. The fusible element of the present application employs a high melting point metal layer and a low melting point metal layer as a main component which may include but not limited to lead-free materials.

The above-described embodiments of the present invention are intended to be illustrative only. Numerous alternative embodiments may be devised by persons skilled in the art without departing from the scope of the following claims.

What is claimed is:

1. A protection device, comprising:

a substrate having a surface provided with a first electrode and a second electrode;

a fusible element disposed on the substrate and connecting to the first electrode and the second electrode at two ends, the fusible element comprising a first metal layer and a second metal layer, the second metal layer being disposed on the first metal layer, the second metal layer having a melting point lower than that of the first metal layer; and a heating element disposed on the substrate, the heating element heating up to blow the fusible element in the event of over-voltage or over-temperature, wherein the second metal layer is at least 40% and less than 60% of the fusible element in thickness, wherein the protection device passes an over-voltage test where a current is applied to the heating element of the protection device to generate a power of 7 W-35 W such that the fusible element in a circuit is blown to open the circuit, and wherein the fusible element is blown within 10 seconds with the power of 7 W-35 W applied to the protection device.

2. The protection device of claim 1, wherein the second metal layer is thicker than the first metal layer.

3. The protection device of claim 1, wherein the first metal layer comprises silver, copper, gold, nickel, zinc or alloys thereof.

4. The protection device of claim 1, wherein the second metal layer comprises tin or alloys thereof.

5. The protection device of claim 1, wherein the first metal layer is an inner layer of the fusible element and the second metal layer is an outer layer of the fusible element.

6. The protection device of claim 1, wherein the second metal layer comprises two layers disposed on an upper surface and a lower surface of the first metal layer.

7. The protection device of claim 1, wherein the first metal layer forms a bottom surface of the fusible element and the second metal layer forms a top surface of the fusible element.

8. The protection device of claim 1, wherein the first metal layer has a thickness equal to or greater than 16 μm, and the second metal layer has a thickness greater than 50% of a thickness of the fusible element.

9. A circuit protection apparatus, comprising:

a protection device, comprising:

a substrate having a surface provide with a first electrode and a second electrode;

a fusible element disposed on the substrate and connecting to the first electrode and the second electrode at two ends, the fusible element comprising a first metal layer and a second metal layer, the second metal layer being disposed on the first metal layer, the second metal layer having a melting point lower than that of the first metal layer, the second metal layer being at least 40% and less than 60% of the fusible element in thickness; and a heating element disposed on the substrate, wherein the protection device passes an over-voltage test where a current is applied to the heating element of the protection device to generate a power of 7 W-35 W such that the fusible element in a circuit is blown to open the circuit, and wherein the fusible element is blown within 10 seconds with the power of 7 W-35 W applied to the protection device;

a detector senses a voltage drop or a temperature of the circuit to be protected; and a switch coupled to the detector to receive signals of the detector;

wherein the switch turns on to allow current to flow through the heating element by which the heating element heats up to blow the fusible element when the detector senses the voltage drop or the temperature exceeding a threshold value.

10. The circuit protection apparatus of claim 9, wherein the second metal layer is thicker than the first metal layer.

11. The circuit protection apparatus of claim 9, wherein the first metal layer is an inner layer of the fusible element and the second metal layer is an outer layer of the fusible element.

12. The circuit protection apparatus of claim 9, wherein the first metal layer has a thickness equal to or greater than 16 μm, and the second metal layer has a thickness greater than 50% of a thickness of the fusible element.

* * * * *